United States Patent [19]

Hulinsky

[11] 3,992,833

[45] Nov. 23, 1976

[54] APPARATUS FOR MOUNTING A WINDOW OR A DOOR FRAME

[76] Inventor: Josef Hulinsky, Dieselstrasse 17, A-4400 Steyr, Austria

[22] Filed: June 3, 1975

[21] Appl. No.: 583,261

[30] Foreign Application Priority Data

| | | |
|---|---|---|
| June 5, 1974 | Austria | 4645/74 |
| July 30, 1974 | Austria | 6260/74 |
| Apr. 1, 1975 | Austria | 2470/75 |

[52] U.S. Cl. ..... 52/206; 52/213; 49/505

[51] Int. Cl.[2] ..... E06B 1/04; E05D 15/22

[58] Field of Search ..... 52/206, 213, 217; 49/505, 164, 165

[56] References Cited

UNITED STATES PATENTS

| | | | |
|---|---|---|---|
| 1,179,597 | 4/1916 | Zahner | 49/505 |
| 1,203,437 | 10/1916 | Urmson | 49/505 |
| 1,389,136 | 8/1921 | Hutchinson | 49/164 |
| 1,718,813 | 6/1929 | Finley | 49/505 |
| 2,323,625 | 7/1943 | Seaman | 52/217 |
| 2,591,979 | 4/1952 | Turley | 49/505 |
| 2,595,506 | 5/1952 | Backman | 52/217 |
| 2,664,600 | 1/1954 | Smith | 49/164 |
| 3,007,559 | 11/1961 | Goldberg | 49/505 |
| 3,060,522 | 10/1962 | Parker | 49/505 |
| 3,685,226 | 8/1972 | Richter | 49/505 |

FOREIGN PATENTS OR APPLICATIONS

| | | | |
|---|---|---|---|
| 440,649 | 12/1967 | Switzerland | 52/217 |

*Primary Examiner*—James L. Ridgill, Jr.
*Attorney, Agent, or Firm*—Karl F. Ross; Herbert Dubno

[57] ABSTRACT

A door or window frame is provided at a pair of opposite locations with tilting means mounting the frame in a wall opening for pivotal movement about an axis perpendicular to these sides of the frame. The frame is also equipped with fixing means which may be extended to engage the structure once the frame is in place. Where necessary, holding devices which are engaged upon pivotal movement of the frame are provided upon the frame and the structure along sides other than those carrying the tilting means, all of the several means and devices being locked once the frame is properly positioned by locking nuts or the like.

24 Claims, 11 Drawing Figures

APPARATUS FOR MOUNTING A WINDOW OR A DOOR FRAME

1. Field of the Invention

The present invention relates to a door-or a window-mounting apparatus and to a method for mounting window and door casings in wall openings. More particularly this invention concerns the use of three installation devices for mounting, fixing, and adjusting a window or door casing in a wall opening, and the sealing of the casing after insertion.

2. Background of the Invention

It is known to insert window frames and door casings (hereinafter referred to generically as "frames") into an opening in the wall of a structure. For this purpose it is necessary to install a receptor frame, usually made from wood, in the wall opening first, and then screw the window or door casing into the receptor frame. It is customary that window and door casings be wedged (for plumb and level positioning) and then walled in. The installation of the window and door frames has to be done on the construction site, and is an expenditure of energy. The proper fitting of the window or door casings with wedges is complicated, time consuming and labor consuming.

OBJECTS OF THE INVENTION

It is an object of the invention to provide a door or window mounting apparatus system and a method for the insertion of window and door casing into an opening of a structure which is expedient, saves cost, and makes it possible to omit the separate installation of receptor frames.

It is an object of the present invention to provide improved means for inserting window frames and door casings into wall openings.

It is another object of the present invention to provide installation devices whereby the aforementioned disadvantages are avoided.

It is still another object of the present invention to provide an improved method for installing and sealing window frames and door casings in wall openings.

SUMMARY OF THE INVENTION

These objects are obtained according to the present invention with two and, preferably, three different sets of devices for installing a window frame or door casing (hereinafter "frames") in a wall opening and filling the gap between frame and wall with a sealing material.

In accordance with the invention, therefore, the three sets of different devices include tilting means, fixing means, and anchor means. Each device basically comprises two parts, whereby one part is fastened to or engages the wall at the opening and the other part is fastened to the frame of the door or window to be inserted.

One of the tilting means is installed between the middle of each jamb of the frame and vertical side of the wall opening. The door or window assembly is hooked into place by engaging the two parts of each tilting means.

The parts of the anchor means are installed at the horizontal beams of the frame and at the walls in matching position. Depending on the length of the frame beams one or more anchor means can be used. The door or window frame which, in a tilted position, is hooked into the tilting means is now swung into its use position, and the two parts of the anchor means lock and keep the frame in this position.

The clamping-apparatus is installed at the portions of the frame or case beams and jambs extending beyond the tilting or anchor means, and at the matching places of the side wall of the opening. They are used to properly adjust the frame relative to the sides of the opening and lock the frame in place therein.

It is another feature of the invention to provide the anchored supporting plate of the clamping device with a movable sleeve. The sleeve has a thread for receiving a screw which pivots on the opposite supporting plate. A working surface for turning the screw is provided.

The tension and compression members can comprise screw bolts preferably having polygonal heads engageable by a tool for turning, and an oppositely running thread. The screws grip in the sleeves in wall and frame, and are attached to a supporting plate or to a tension anchor. It is also possible to have just one thread turning in a single counter-thread whereby the second supporting plate pivots as an axle or axle-shaped extension inserted in a hole of the supporting plate.

Because the torsional stresses only occur during adjusting, the construction of the elements defining the axes need not be very accurate and can be punched, forged, cast, etc. By pushing the supporting plates apart the door or window case can be easily, simply and accurately adjusted. After the adjustment all devices can be fixed (locked).

According to yet another feature of the present invention the gap between window and door case and the wall opening is closed by filling in sealing material such as foam material, or expanded plastic material, for instance polyurethane.

It has been found to be very practical to fill the gap with a material which starts foaming after insertion and thereby guarantees a proper seal by totally filling the gap between case and wall. Such a foam, e.g. polyurethane foam, seals excellently, affords very good thermal insulation and also adds to the stability of the case installation.

The invention also comprises a method of mounting a frame in a wall opening of a structure comprising the steps of pivotally securing said frame to the structure on opposite sides of the frame whereby the frame is swingable in the opening about an axis perpendicular to the sides, swinging the frame into position in the opening and advancing fixing members on the frame along other sides of the frame to apply compression thereto against the structure and lock the frame in place. We also seal any resulting spaces between said structure and said frame. The frame is fixed in place in the opening at least in part by swinging a pair of elements of an anchor device into engagement with one another by pivoting the frame relative to the structure.

BRIEF DESCRIPTION OF THE DRAWING

The above and other objects, features, and advantages of the present invention will become more readily apparent from the following description, reference being made to the accompanying drawing in which:

FIG. 7 is a front view of an installed window case, with fixing apparatus 4*a*, 4*b* of FIGS. 1, 2, tilting apparatus 3*a*, 3*b* of FIGS. 3, 4, and clamping apparatus 2 of FIGS. 5, 6 built in;

SPECIFIC DESCRIPTION

Figure 2:
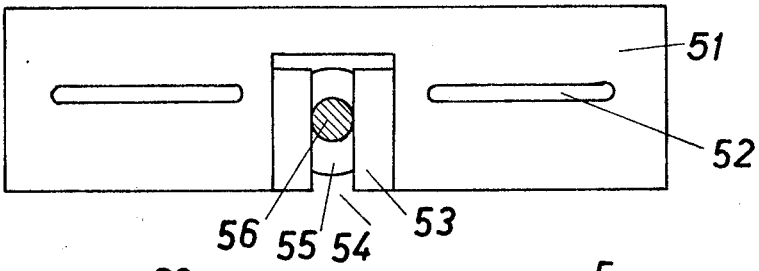
FIG. 2 is a cross sectional top view taken along line I — I of FIG. 1, showing the base plate 4*a* of the two-part fixing apparatus of FIG. 1.
Figure 1:
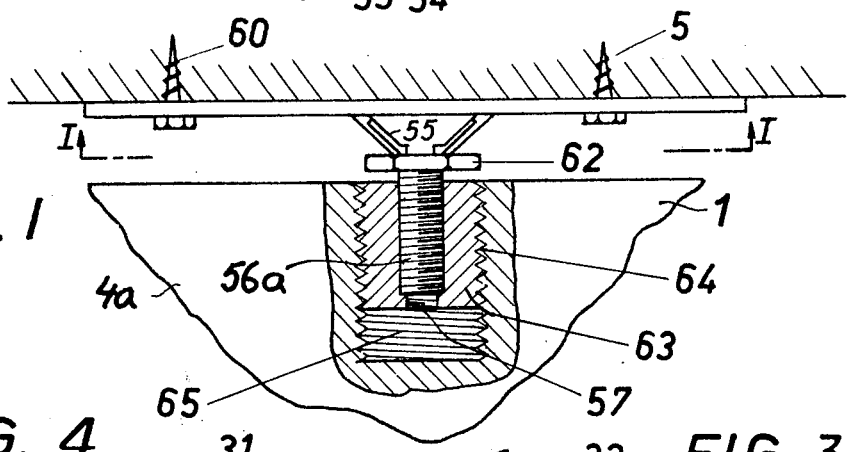
FIG. 1 is a side view of a fixing apparatus comprising parts 4*a* and 4*b;*

The fixing apparatus shown in FIGS. 1 and 2 comprising parts 4*a* and 4*b* has a base plate 51 with slotted holes 52 said base plate 51 is anchored to the wall 5 by screws 60 through provided slotted holes 52, latter allowing the readjustment of the position of the plate 51. Base plate 51 is provided with upward bents 53 forming a slanted slot 54 for inserting screw 56. Screw 56 has on two sides below its head 55 slot-shaped constrictions and a thread 56*a*. Screw 56 can with its recess below screw head 55 be inserted into slot 54 and is after being inserted, because of its recess, unturnable. A nut 62 serves to hold and keep screw 56 in position in slot 54. Screw 56 is screwed into a thread-bearing body 63 which has an internal thread 57. Thread-bearing body 63 has an external thread 64 with which it is screwed into a bore 65 of case 1.

Figure 4:
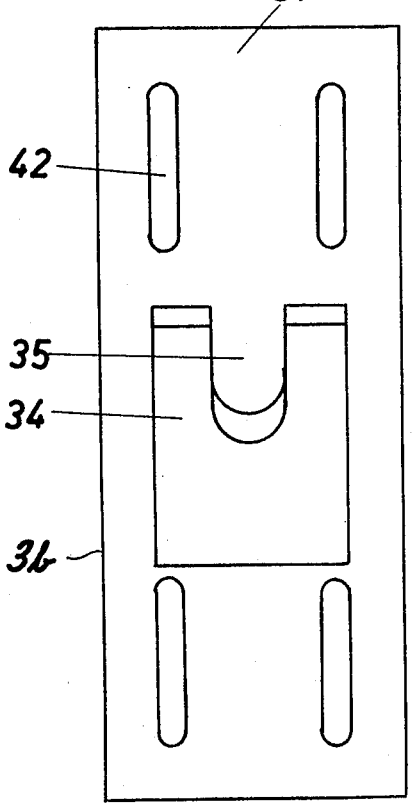
FIG. 4 is a top view of the base plate 3*a* of the two-part tilting apparatus shown in FIG. 3.
Figure 3:
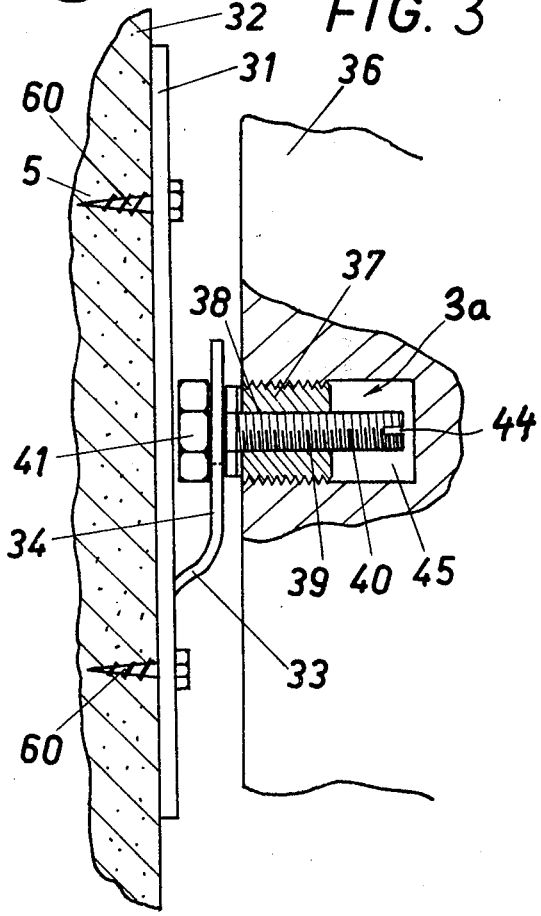
FIG. 3 is a side view of a tilting apparatus comprising parts 3*a* and 3*b;*

The tilting apparatus shown in FIG. 3 and FIG. 4 comprising parts 3*a* and 3*b* has a base plate 31 with slotted holes 42 for insertion of screws 60 which fasten plate 31 to a wall 32 of a door- or window opening. Base plate 31 provides a tongue plate 34 attached by a web 33. Tongue plate 34 has a slotted opening 35. Screw 40 with screwhead 41 has a cut-in recess below its head 41 and the other end of the screw 40 opposing the screwhead has a slot 44 for inserting a screwdriver. A thread-bearing body 37 with an internal thread 38 for receiving thread 39 of screw 40, can be screwed into a borehole 45 of case 36.

Figure 6:
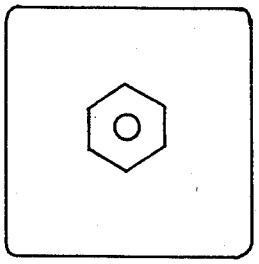
FIG. 6 is a top view of the clamping apparatus shown in FIG. 5.
Figure 5:
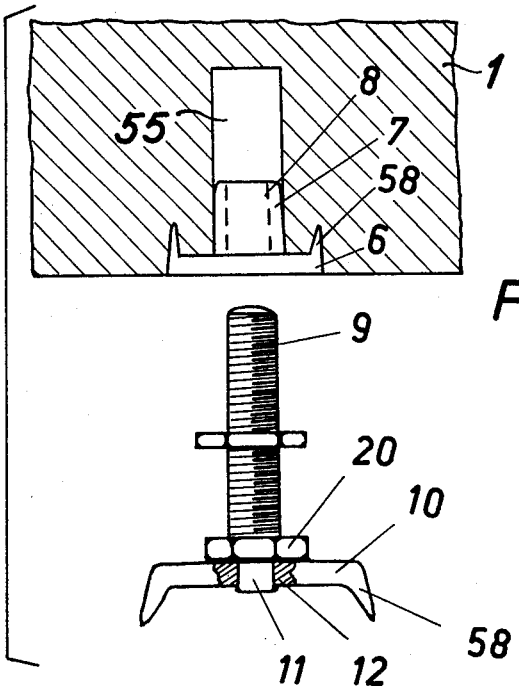
FIG. 5 is a side view of a clamping apparatus.

The clamping apparatus shown in FIG. 5 and FIG. 6 has a supporting plate 10 which is provided with anchor spikes 58. Plate 10 has a borehole 12 with a rivet elongation 11 on which a screw 9 with a hexagon head 20 is pivoted. The clamping apparatus shown in FIG. 5 and FIG. 6 also has a second supporting plate 6 with anchor spikes 58, a collet 7 with an internal thread 8 is anchored into a borehole 55 of case 1.

Figure 7:
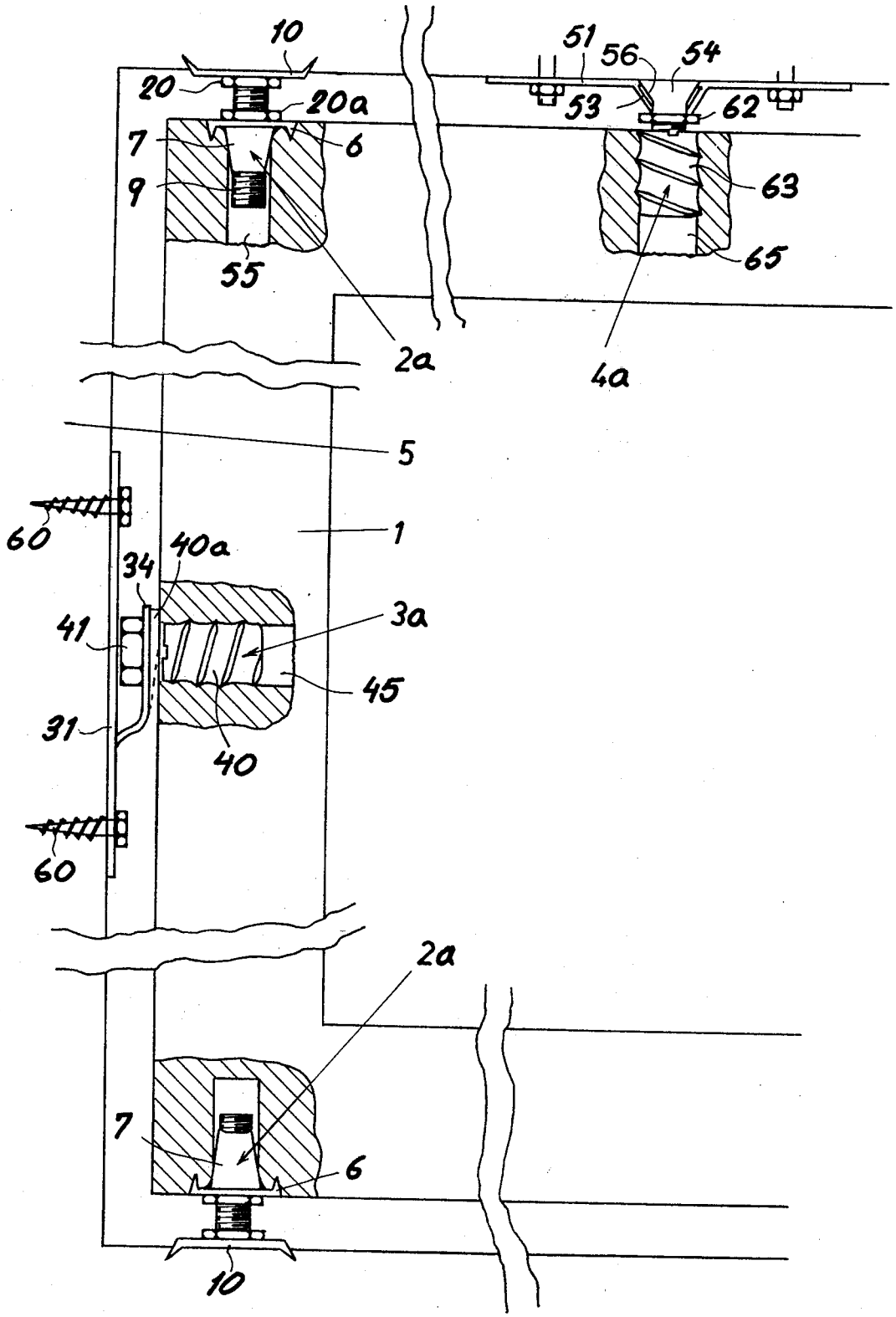

FIG. 7 shows the positions of the fixing apparatus 4, according to FIG. 1, 2, the tilting apparatus/according to FIG. 3, 4, and clamping apparatus 2 according to FIG. 5, 6 in an installed window or door case. To insert a window or door case 1 into an opening of wall 5 the necessary fixing-parts 2*a*, 3*a*, 4*a*, according to the present invention, are attached to the case.

FIG. 7 shows in the vertical side wall of an opening 1 tilting apparatus according to the present invention with its base plate 31 secured to wall 5 by means of screws 60 and on the horizontal surface of the beam of the case 1 an anchored base-plate 51 of fixing apparatus 4 according to present invention. Boreholes 45 and 65 in the case are matching the position of base-plates 31 and 51.

Thread-bearing bodies 37 and 63 are screwed into boreholes 45 and 65. Screw 40 with screwhead 41, and check nut is screwed into a thread-bearing body 37, and screws 56 with nut 62 is screwed into a thead-bearing body 63. The case is now lifted, screws 40 are slipped into slots 35 (see FIG. 3) of base-plates 31 is such way, that the screwheads 41 are positioned between base-plate 31 and tongue-plate 34. Therewith the case hangs swingable around screws 40-in tongue-plate 34 and can be swiveled and adjusted into the right position. When swinging, screw 56 slips behind the upward bends 53 of base-plate 51 of the fixing-apparatus whereby recess 61 -created by lateral longitudinal milling-slides into slot 54 and is held by sides of bends 53, the screw now can not be turned and the head is fixed by tightening nut 62 with a screw spanner inserted in gap between case 1 and wall 5.

To ease adjusting and for fastening of case, holes 55 are drilled into the extending ends of the case beams, these holes receive collets 7 with support-plate 6 (shown in FIG. 6), with screw 9 plate 10 is put into position, whereby screw 9 is screwed in as far as possible. To adjust the frame, screw 9 of the clamping device (shown in FIG. 5) which is installed in the extending ends of the case beams, is turned with a wrench on its hexagon head 20 until plates 6 and 10 receive pressure and are pushed apart until the case is adjusted to its proper position. This position is fixed with a check nut 20*a*.

By tightening the check nuts 40*a* of screws 40 the tilting device is also fixed into position and a connection between wall and case resistant to compression and tension is established. Therewith the case is fixed. Depending on size of the case more or less fixing- and clamping devices can be used. Depending on the size of the window respectively on the size of the case, and on the length of the case beams, more or less installing elements according to the present invention can be used.

Figure 8:
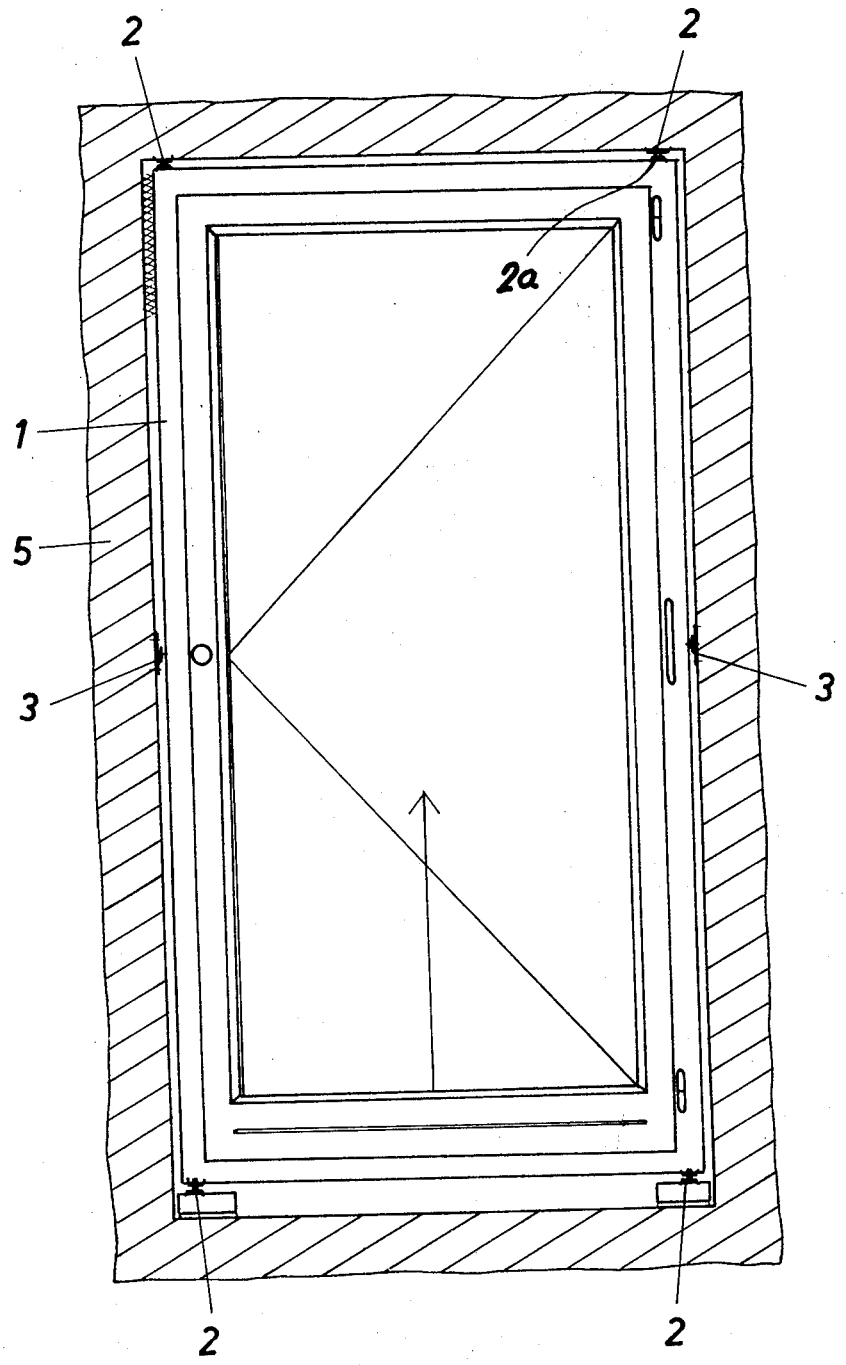
FIG. 8 is a front elevation of a door installed by using tilting apparatus 3 shown in FIGS. 3, 4 and clamping apparatus 2 shown in FIGS. 5, 6.

FIG. 8 shows the fastening of a case for a lifting door. Two tilting-apparatuses 3 are used, one each at the vertical sides of the wall opening, and the case. The fixing of the door case is done by only using two clamping apparatuses at the extending ends of the door jambs. Because the case beams are of short length no fixing apparatus for taking tensional and compressive stresses is necessary in mid-beam.

Figure 9:
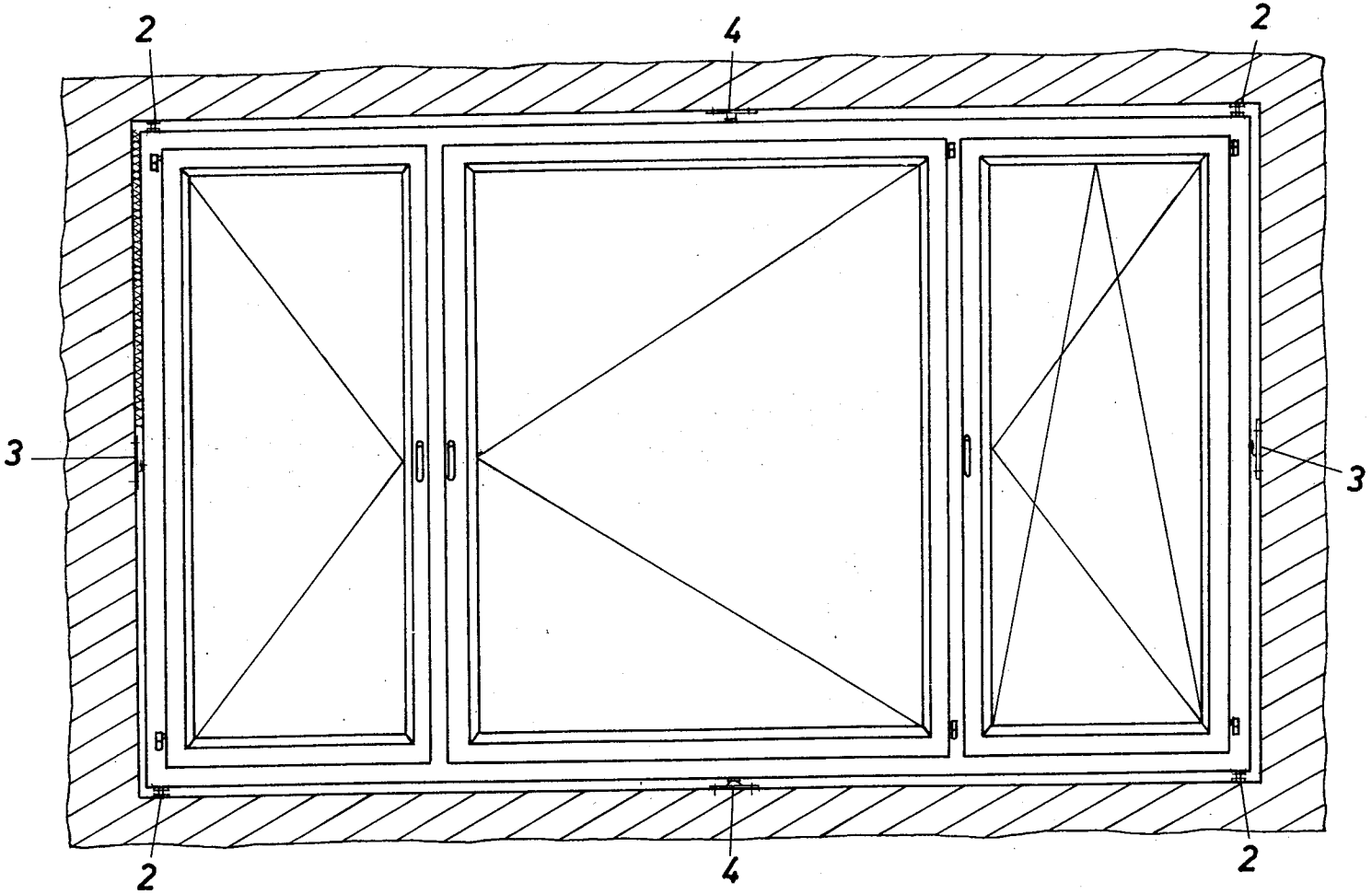
FIG. 9 is a front elevation of a window installed by using tilting apparatus 3 shown in FIGS. 3, 4 fixing apparatus 4 shown in FIGS. 1, 2 and clamping apparatus 2 shown in FIGS. 5, 6.

FIG. 9 shows the installation of a three-part window with tilting-apparatus 3, fixing-apparatus 4, and clamping-apparatus 2.

Figure 10:
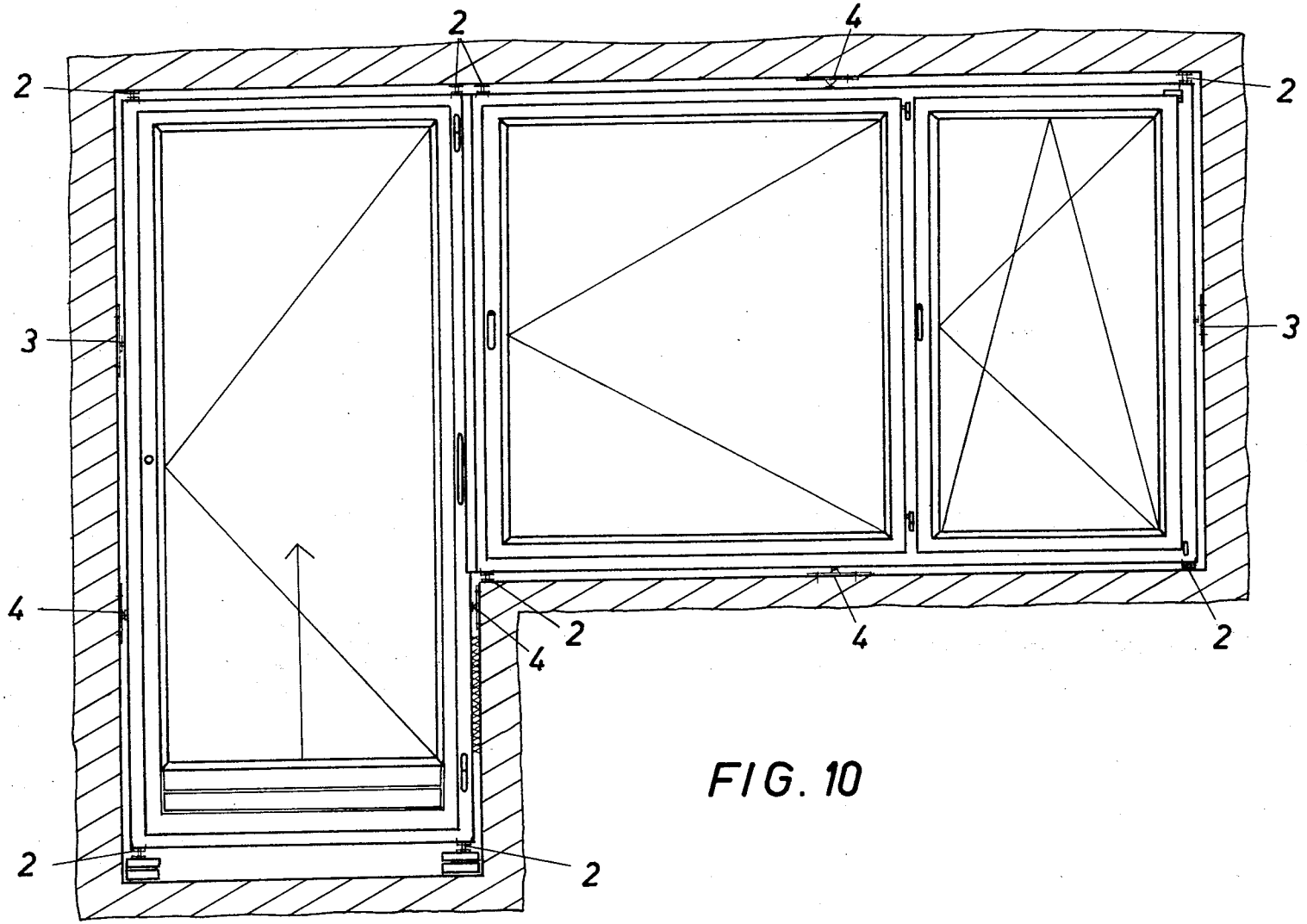
FIG. 10 is a front view of a window-door combination installed by using clamping 2, tilting 3, and fixing apparatus 4 as shown in FIGS. 1 to 6.

FIG. 10 shows the installation of a door with an adjacent window, only two tilting apparatuses are used for fastening which is possible if the gap between wall and case is big enough to make hooking of screw 40 in slot 35, see FIG. 3, possible by lifting of the casing. At the extending ends of the vertical jambs clamping-apparatuses are installed. Fixing apparatus 4 for taking tensional and compressive stresses are fastened at the long beams of the casing.

Figure 11:
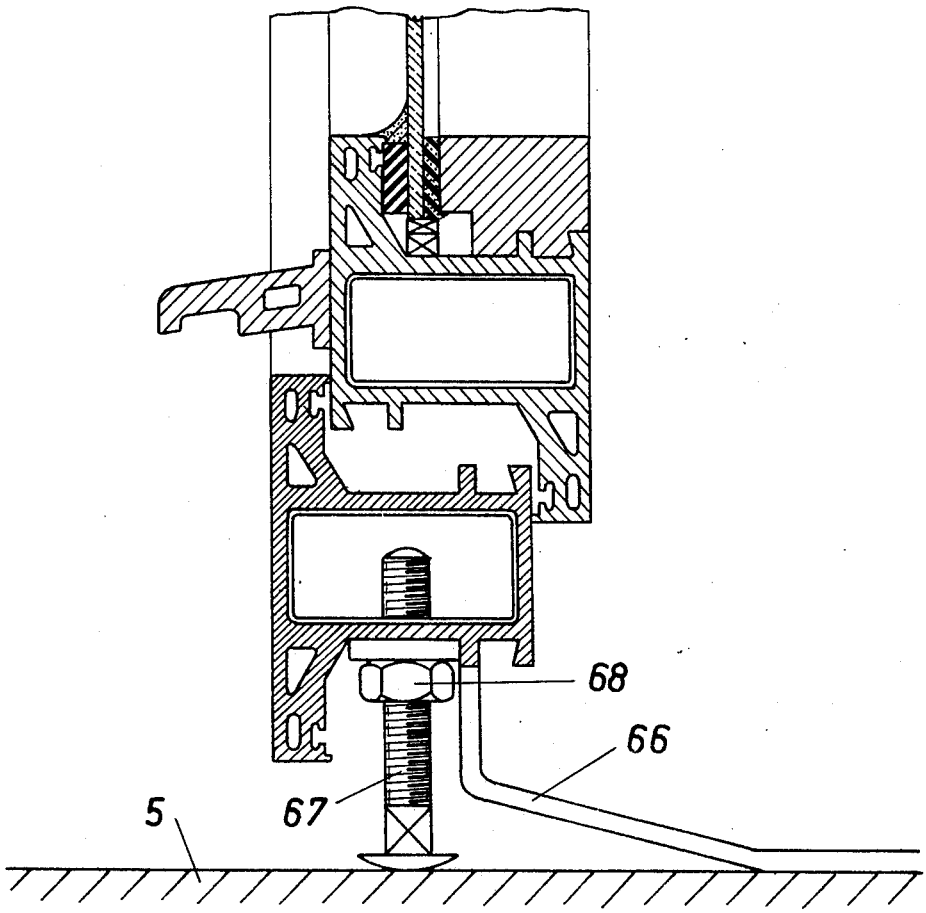
FIG. 11 is a cross section of an installation detail for a profile-window case.

FIG. 11 shows an additional anchorage of a profile casing in wall 5 with clamp 66, whereby the distance between casing and wall is kept by a common carriage bolt 67 and a nut 68. The anchored wall clamp 66 can be put around each shown screw to stabilize the installation.

After locking the casing into proper position the gap between case and wall is filled with sealing material, or preferably with expanded plastic material, which starts foaming only after insertion, such as polyurethane foam. After this it is practical to attach the facing strips, and with this the casings are installed. Windows and doors can be hooked in. Fastening and adjusting can be quickly and easily done by one man, or if the window is too heavy only the help of untrained labor is required.

Constructional variants can be used for tilting, fixing, and clamping apparatus according to the present invention. Depending on the requirement more or less installation elements of the present invention can be used. For example, small window cases can be inserted with just two clamping-apparatuses, although it is practical to also install clamping-apparatuses at the extending ends of the horizontal case beams. It is also possible to just use tilting-apparatus and do the fixing with wall clamps, whereby a height-adjusting mechanism can be provided as part of the tilting-apparatus, and fastening means other than aforementioned can be used.

I claim:

1. An apparatus for fastening a frame in an upright wall opening of a structure, comprising said wall opening having opposite vertical sides;

respective tilting means mounted in said wall opening and pivotally engaging said frame between each of said sides and a respective side of said frame, each of said tilting means including a pair of members defining a pivot axis and relatively rotatable about said axis, one of the members of each pair being insertable into the other member in a direction transverse to the axis, a first member of each pair being mounted on said frame and a second member of each pair being mounted on said structure; and a plurality of fixing means mounted on at least one other side of said frame and engageable with said structure in said opening for securing said frame in place therein, one member of each pair including a base plate mounted on a respective side of said opening and facing said frame, a lug spaced-from and substantially parallel to said base plate, and means connecting said lug to said base plate, said lug having an upwardly extending slot opening at an upper edge thereof, the other member of said pair being a head screw having a shank receivable in said slot and a head receivable between said lug and said base plate, said frame being formed with internally threaded bores receiving internally-and-externally threaded bushings, said head screws being threaded into said bushings.

2. The apparatus defined in claim 1 wherein said frame is a window frame having a window prehung therein.

3. The apparatus defined in claim 1 wherein said frame is a door casing having a door prehung therein.

4. The apparatus defined in claim 1 wherein said frame is part of an assembly comprising a door casing and a window frame, a door being prehung in said door casing and a window being prehung in said window frame.

5. The system defined in claim 1 wherein each of said tilting means includes locking means for fixing the members of the respective pair against relative displacement.

6. The apparatus defined in claim 5 wherein each of said heads has a polygonal formation engageable by a tool for rotating the respective screw.

7. The apparatus defined in claim 5 wherein each of said locking means includes at least one nut threaded onto the respective screw for securing same against the respective lug.

8. The apparatus defined in claim 5 wherein each of said base plates is formed with a plurality of elongated slots, said tilting means each including respective screws for securing said base plate adjustably to said structure through the slots of said base plates.

9. The apparatus defined in claim 5 wherein said screws are each formed with a step smaller than the diameter of its threaded portion, said slots each having a width greater than the diameter of said step but smaller than the diameter of the threaded portions of the respective screw.

10. The apparatus defined in claim 5 wherein each of said screws is formed at its end opposite the respective head with a slit engageable by a screw-driver, said frame having a through-going bore receiving the respective bushing.

11. The apparatus defined in claim 1 further comprising anchor means including an element mounted on said structure and an element mounted on said frame on one of said other sides thereof and engageable upon tilting movement of said frame about said axis for securing said frame in position in said opening.

12. The apparatus defined in claim 11 wherein said element mounted on said structure comprises a slot open at one end thereof and said element mounted on said frame includes a pin engageable in said slot through said end, and locking means for fixing said elements against relative displacement.

13. The apparatus defined in claim 12 wherein said plate is provided with a plurality of elongated windows, said anchor means including screws traversing said windows and securing said plate of said structure, said plate being provided with a pair of bends projecting away from said structure and defining said slot between them, said pin having a head receivable behind said bends.

14. The apparatus defined in claim 13 wherein said bends are inclined toward one another and toward said frame, said head being conical with a taper corresponding to the angle included between said bends.

15. The apparatus defined in claim 13 wherein said anchor means further comprises a thread carrier received in said frame and threadly receiving said screw.

16. The apparatus defined in claim 13 wherein said locking means includes a locking nut threaded onto said screw.

17. The apparatus defined in claim 1 wherein said frame has a pair of vertical sides and a pair of horizontal sides, at least two such fixing means being provided at spaced apart locations on each of said other sides, said fixing means each comprising a compression device pressing the respective frame side away from the juxtaposed portion of said structure.

18. The apparatus defined in claim 17 wherein two such devices are provided along each horizontal side of the frame.

19. The apparatus defined in claim 17 wherein two such devices are provided along each vertical side of the frame.

20. The apparatus defined in claim 22 wherein said first body comprises a pressure plate anchored in said frame, said frame being formed with a bore aligned with said pressure plate, and a threaded sleeve received in said bore and retained therein by said pressure plate, said sleeve being provided with an internal thread receiving the last mentioned screw.

21. The apparatus defined in claim 20 wherein last mentioned screw is formed with a prismatic portion engageable for rotation of said screw relative to at least one of said bodies.

22. The apparatus defined in claim 17 wherein each of said devices includes a first body fixed in said frame against displacement relative thereto, a second body engageable with said structure in said opening against displacement relative to said structure, and a screw threadably received in one of said bodies and bearing upon the other of said bodies while spanning a space between them.

23. The apparatus defined in claim 22 wherein both of said bodies are plates formed with barbs adapted to penetrate into said frame and said structure respectively.

24. The apparatus defined in claim 23, further comprising a pair of locking nuts on said screw adapted to be brought up against each of said bodies for locking said bodies in mutually fixed locations.

* * * * *